US011795940B2

(12) United States Patent
Robinson, III et al.

(10) Patent No.: US 11,795,940 B2
(45) Date of Patent: Oct. 24, 2023

(54) DAMPER FOR A COMPRESSOR OF AN AIR CONDITIONING APPLIANCE

(71) Applicant: Haier US Appliance Solutions, Inc., Wilmington, DE (US)

(72) Inventors: Charles D. Robinson, III, Louisville, KY (US); Joseph Robert Tobbe, Louisville, KY (US); Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 159 days.

(21) Appl. No.: 17/351,390

(22) Filed: Jun. 18, 2021

(65) Prior Publication Data

US 2022/0403837 A1 Dec. 22, 2022

(51) Int. Cl.

| | |
|---|---|
| ***F04B 53/00*** | (2006.01) |
| ***F25B 1/00*** | (2006.01) |
| ***F24F 1/00*** | (2019.01) |
| ***F24F 1/022*** | (2019.01) |
| ***F24F 1/12*** | (2011.01) |
| ***F24F 1/40*** | (2011.01) |
| ***F24F 13/24*** | (2006.01) |

(52) U.S. Cl.

CPC ..... *F04B 53/003* (2013.01); *F24F 1/00* (2013.01); *F24F 1/022* (2013.01); *F24F 1/12* (2013.01); *F24F 1/40* (2013.01); *F24F 13/24* (2013.01); *F25B 1/00* (2013.01); *F25B 2500/13* (2013.01)

(58) Field of Classification Search

CPC ..... F24F 1/00; F24F 1/022; F24F 1/12; F24F 1/40; F24F 13/24; F25B 1/00; F25B 2500/13; F04B 53/003; F04B 39/0044

See application file for complete search history.

(56) References Cited

U.S. PATENT DOCUMENTS

| | | | | |
|---|---|---|---|---|
| 4,490,992 A * | 1/1985 | Chastine | F25D 21/14 62/448 |
| 4,643,386 A | 2/1987 | Chastine | |
| 4,917,581 A * | 4/1990 | Richardson, Jr. | F04C 29/068 248/634 |
| 4,964,609 A * | 10/1990 | Tomell | F16F 15/08 417/363 |
| 6,260,373 B1 * | 7/2001 | Rockwood | F16F 7/104 165/69 |

(Continued)

FOREIGN PATENT DOCUMENTS

| | | |
|---|---|---|
| CN | 106382202 A | 2/2017 |
| CN | 110145457 B | 5/2020 |

(Continued)

*Primary Examiner* — Lionel Nouketcha

(74) *Attorney, Agent, or Firm* — Dority & Manning, P.A.

(57) ABSTRACT

An air conditioner unit includes a cabinet including a base pan that defines at least one alignment feature and a compressor mounted to the base pan using mechanical fasteners that pass through mounting feet and into mounting bosses defined on the base pan. A damper is positioned between the compressor and the base pan and includes a lower pad seated on the base pan, an upper pad extending from the lower pad along the vertical direction and contacting a bottom surface of the compressor, and at least one stopping feature defined on the lower pad or the upper pad, the at least one stopping feature engaging the at least one alignment feature to prevent rotation of the damper.

19 Claims, 5 Drawing Sheets

(56) References Cited

U.S. PATENT DOCUMENTS

| | | | | |
|---|---|---|---|---|
| 2003/0217563 | A1* | 11/2003 | Wendt | F25B 39/04<br>62/298 |
| 2005/0135943 | A1 | 6/2005 | Caronna | |

FOREIGN PATENT DOCUMENTS

| | | | |
|---|---|---|---|
| CN | 210564972 | U | 5/2020 |
| DE | 202006015443 | U1 | 1/2007 |
| WO | WO2020195047 | A1 | 10/2020 |

* cited by examiner

DAMPER FOR A COMPRESSOR OF AN AIR CONDITIONING APPLIANCE

FIELD OF THE INVENTION

The present subject matter relates generally to air conditioning appliances, and more particularly to vibration reduction or noise damping features for air conditioning appliances.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU) or package terminal air conditioners (PTAC), may be utilized to adjust the temperature in, for example, a single room or group of rooms of a structure. These units typically operate like split heat pump systems, except that the indoor and outdoor portions are defined by a bulkhead and all system components are housed within a single package that is installed in a wall sleeve positioned within an opening of an exterior wall of a building. In this regard, such units commonly include an indoor portion that communicates (e.g., exchanges air) with the area within a building and an outdoor portion that generally communicates (e.g., exchanges air) with the area outside a building. Accordingly, the air conditioner unit generally extends through, for example, an outer wall of the structure, or is otherwise ducted to the outdoors.

Air conditioning units commonly include, for instance, a sealed system to cool or heat the room. The sealed system may include a compressor, one or more heat exchangers, and an expansion device. The operation of the sealed system can often generate noise which may be disturbing to a room occupant, particularly for SPVU, PTAC, or other single-unit room air conditioner installed within or near the room being conditioned. For example, the compressor may vibrate during operation, resulting in noise and vibrations that are noticeable to room occupants.

Accordingly, an air conditioner unit that generates less noise and vibration would be useful. More specifically, a single-unit type air conditioner that includes features for reducing or attenuating compressor vibration and noise would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, an air conditioner unit is provided defining a vertical, a lateral, and a transverse direction. The air conditioner unit includes a cabinet including a base pan, the base pan defining at least one alignment feature, a bulkhead mounted within the cabinet to define an indoor portion and an outdoor portion, a refrigeration loop comprising an outdoor heat exchanger positioned within the outdoor portion and an indoor heat exchanger positioned within the indoor portion, a compressor operably coupled to the refrigeration loop and being configured for urging a flow of refrigerant through the outdoor heat exchanger and the indoor heat exchanger, and a damper positioned between the compressor and the cabinet. The damper includes a lower pad seated on the base pan, an upper pad extending from the lower pad along the vertical direction and contacting a bottom surface of the compressor, and at least one stopping feature defined on the lower pad or the upper pad, the at least one stopping feature engaging the at least one alignment feature to prevent rotation of the damper.

In another exemplary embodiment, a damper for a compressor of an air conditioner unit is provided. The air conditioner unit includes a base pan defining at least one alignment feature. The damper includes a lower pad seated on the base pan, an upper pad extending from the lower pad along a vertical direction and contacting a bottom surface of the compressor, and at least one stopping feature defined on the lower pad or the upper pad, the at least one stopping feature engaging the at least one alignment feature to prevent rotation of the damper.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
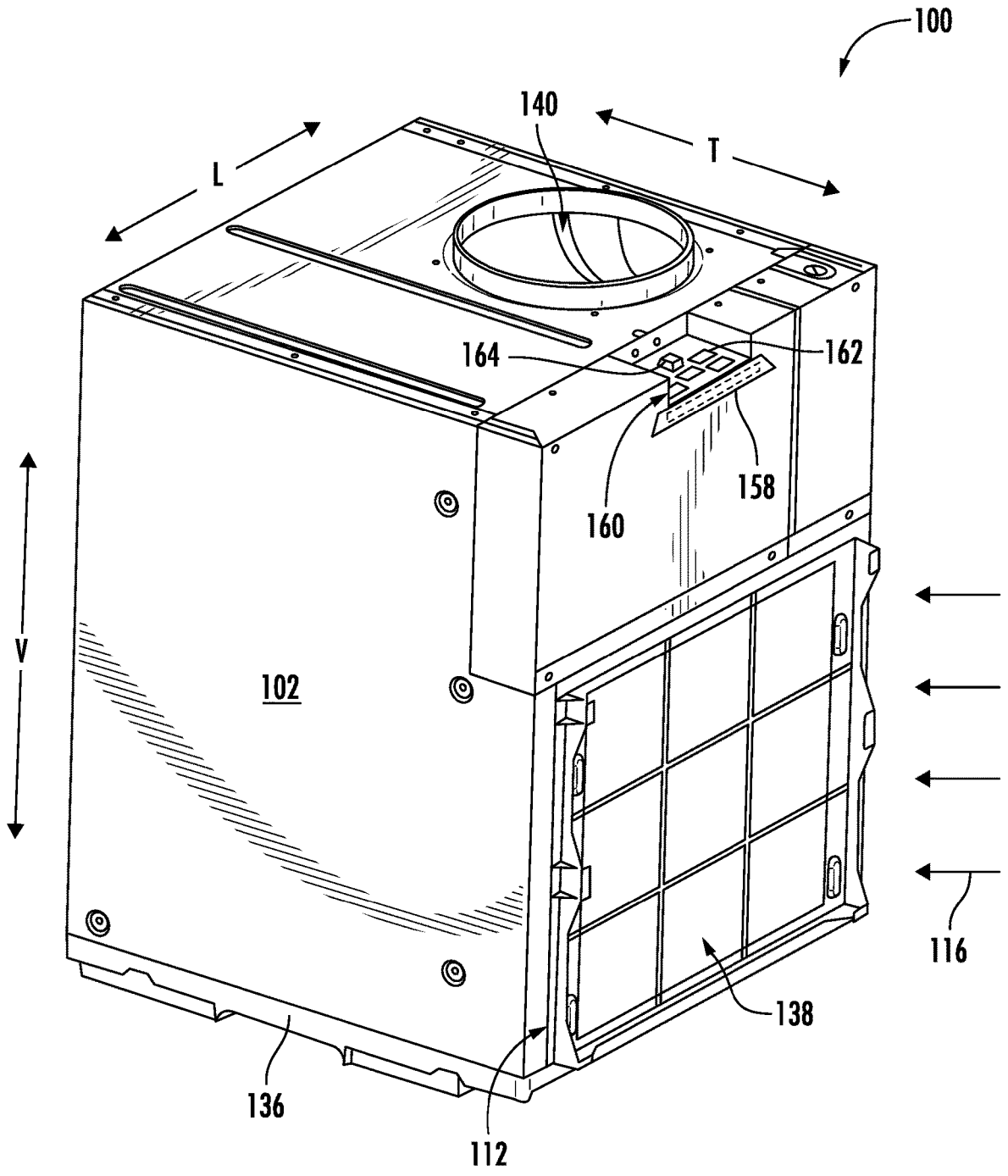
FIG. 1 provides a perspective view of an air conditioning appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
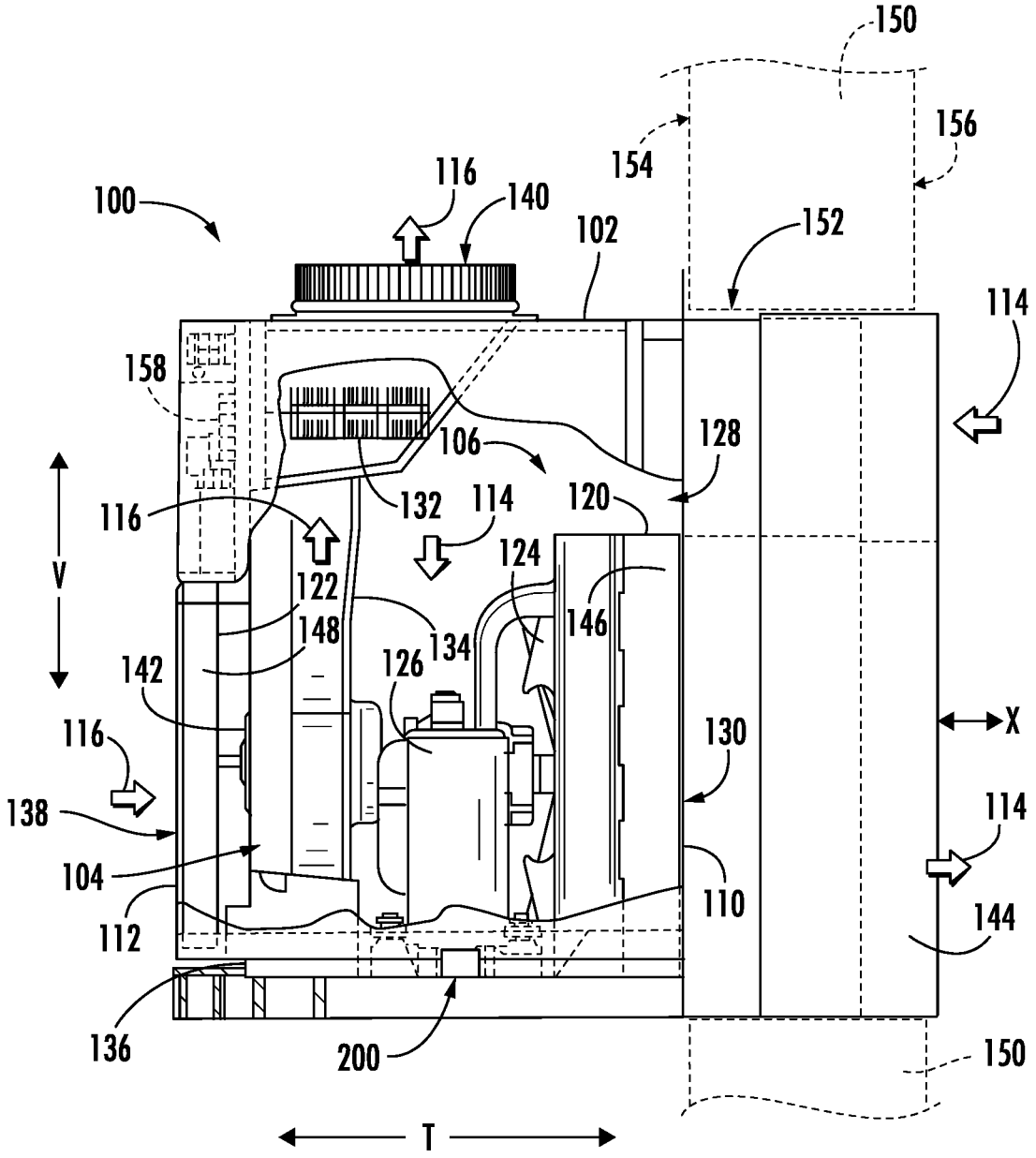
FIG. 2 provides a section view of the exemplary air conditioning appliance of FIG. 1.

Turning now to the figures, FIGS. 1 and 2 illustrate an exemplary air conditioner appliance (e.g., air conditioner 100). Specifically, FIG. 1 provides a perspective view and FIG. 2 provides a cross sectional view of air conditioner 100. As shown, air conditioner 100 may be provided as a one-unit type air conditioner 100, such as a single-package vertical unit (SPVU). However, it should be appreciated that aspects of the present subject matter may be used with other suitable air conditioning units or air filtering devices, such as a packaged terminal air conditioner unit (PTAC), a split heat pump system, etc.

Air conditioner 100 includes a package housing or cabinet 102 supporting and defining an indoor portion 104 and an outdoor portion 106. Generally, air conditioner 100 generally defines a vertical direction V, a lateral direction L, and a transverse direction T. Each direction V, L, T is perpendicular to each other, such that an orthogonal coordinate system is generally defined.

In some embodiments, cabinet 102 contains various other components of the air conditioner 100. Cabinet 102 may include, for example, a rear opening 110 (e.g., with or without a grill or grate thereacross) and a front opening 112 (e.g., with or without a grill or grate thereacross) may be spaced apart from each other along the transverse direction T. The rear opening 110 may be part of the outdoor portion 106, while the front opening 112 is part of the indoor portion 104. Components of the outdoor portion 106, such as an outdoor heat exchanger 120, outdoor fan 124, and compressor 126 may be enclosed within cabinet 102 between front opening 112 and rear opening 110. In certain embodiments, one or more components of outdoor portion 106 are mounted on a base pan 136, as shown. According to exemplary embodiments, base pan 136 may be received within a drain pan, e.g., for collecting condensation formed during operation.

During certain operations, air 114 may be drawn to outdoor portion 106 through rear opening 110. Specifically, an outdoor inlet 128 defined through cabinet 102 may receive outdoor air 114 motivated by outdoor fan 124. Within cabinet 102, the received outdoor air 114 may be motivated through or across outdoor fan 124. Moreover, at least a portion of the outdoor air 114 may be motivated through or across outdoor heat exchanger 120 before exiting the rear opening 110 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 104 may include an indoor heat exchanger 122, a blower fan 142, and a heating unit 132. These components may, for example, be housed behind the front opening 112. A bulkhead 134 may generally support or house various other components or portions thereof of the indoor portion 104, such as the blower fan 142. Bulkhead 134 may generally separate and define the indoor portion 104 and outdoor portion 106 within cabinet 102. Additionally, or alternatively, bulkhead 134 or indoor heat exchanger 122 may be mounted on base pan 136 (e.g., at a higher vertical position than outdoor heat exchanger 120), as shown.

During certain operations, air 116 may be drawn to indoor portion 104 through front opening 112. Specifically, an indoor inlet 138 defined through cabinet 102 may receive indoor air 116 motivated by blower fan 142. At least a portion of the indoor air 116 may be motivated through or across indoor heat exchanger 122 (e.g., before passing to bulkhead 134). From blower fan 142, indoor air 116 may be motivated (e.g., across heating unit 132) and returned to the indoor area of the room through an indoor outlet 140 defined through cabinet 102 (e.g., above indoor inlet 138 along the vertical direction V). Optionally, one or more conduits (not pictured) may be mounted on or downstream from indoor outlet 140 to further guide air 116 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base pan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

According to an example embodiment, compressor 126 may be a variable speed compressor. In this regard, compressor 126 may be operated at various speeds depending on the current air conditioning needs of the room and the demand on the sealed system. For example, according to an exemplary embodiment, compressor 126 may be configured to operate at any speed between a minimum speed, e.g., 1500 revolutions per minute (RPM), to a maximum rated speed, e.g., 3500 RPM. Notably, the use of variable speed compressor 126 enables efficient operation of the sealed system, minimizes unnecessary noise when compressor 126 does not need to operate at full speed, and ensures a comfortable environment within the room.

According to exemplary embodiments, air conditioner 100 may further include a plenum 144 to direct air to or from cabinet 102. When installed, plenum 144 may be selectively attached to (e.g., fixed to or mounted against) cabinet 102 (e.g., via a suitable mechanical fastener, adhesive, gasket, etc.) and extend through a structure wall 150 (e.g., an outer wall of the structure within which air conditioner 100 is installed) and above a floor of the structure. In particular, plenum 144 extends along an axial direction X (e.g., parallel to the transverse direction T) through a hole or channel 152 in the structure wall 150 that passes from an internal surface 154 to an external surface 156. In addition, it should be appreciated that plenum 144 may be formed from two or more telescoping structures, e.g., to accommodate different thicknesses of structure wall 150.

The operation of air conditioner 100 including compressor 126 (and thus the sealed system generally), blower fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Notably, as explained briefly above, vibrations and noise generated by the operation of the sealed system of an air conditioner unit may disturb a user or room occupant, particularly in single unit air conditioner installations. Specifically, for example, sealed system compressors may generate torsional movement and vibrations, e.g., about a vertical axis of the compressors. As such, aspects of the present subject matter are directed to features for damping or reducing vibration and/or noise generated by compressors of air conditioner units.

Figure 3:
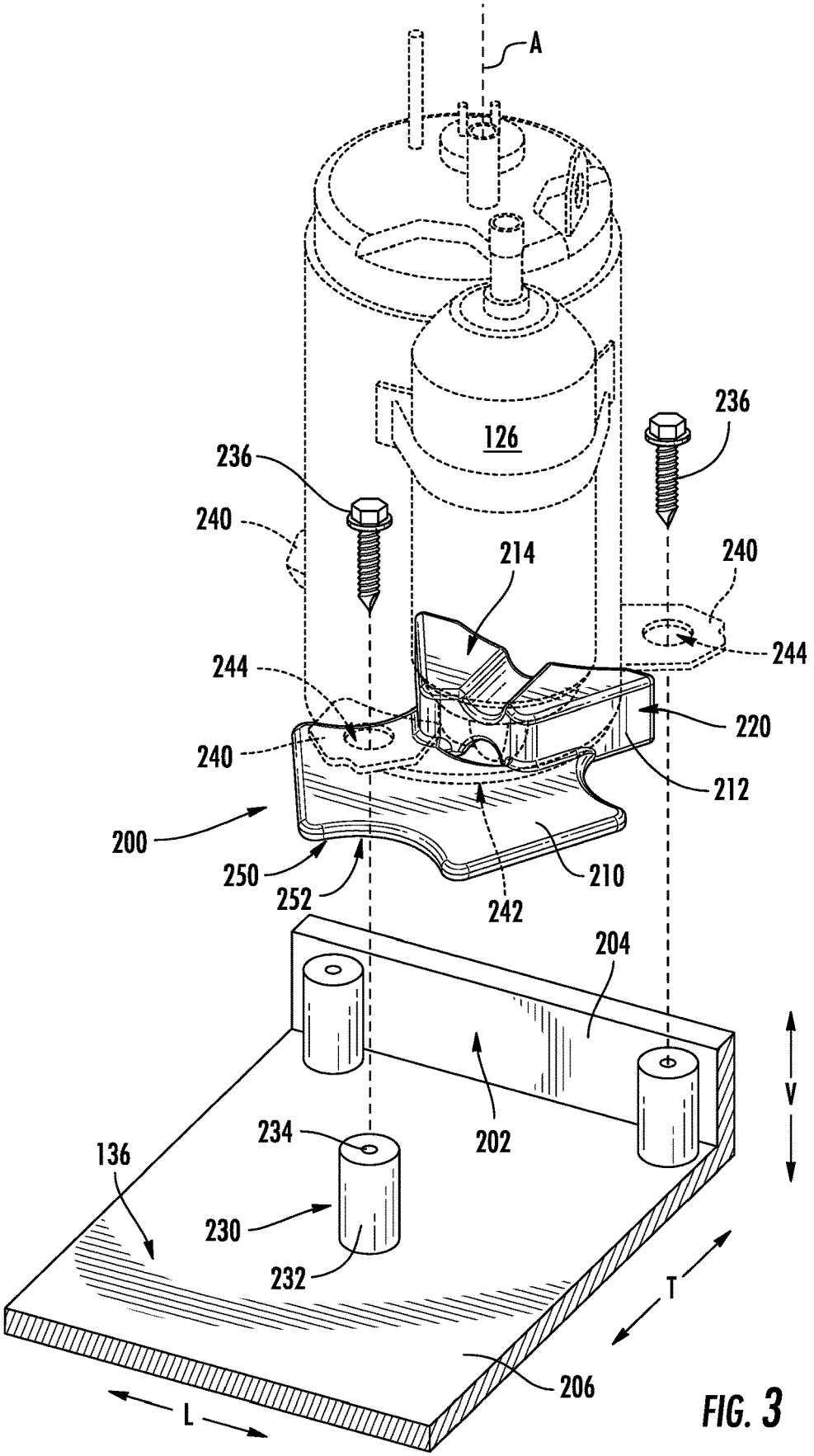
FIG. 3 provides a perspective view of a compressor of the exemplary air conditioning appliance of FIG. 1 seated on a damper according to an exemplary embodiment of the present subject matter.
Figure 4:
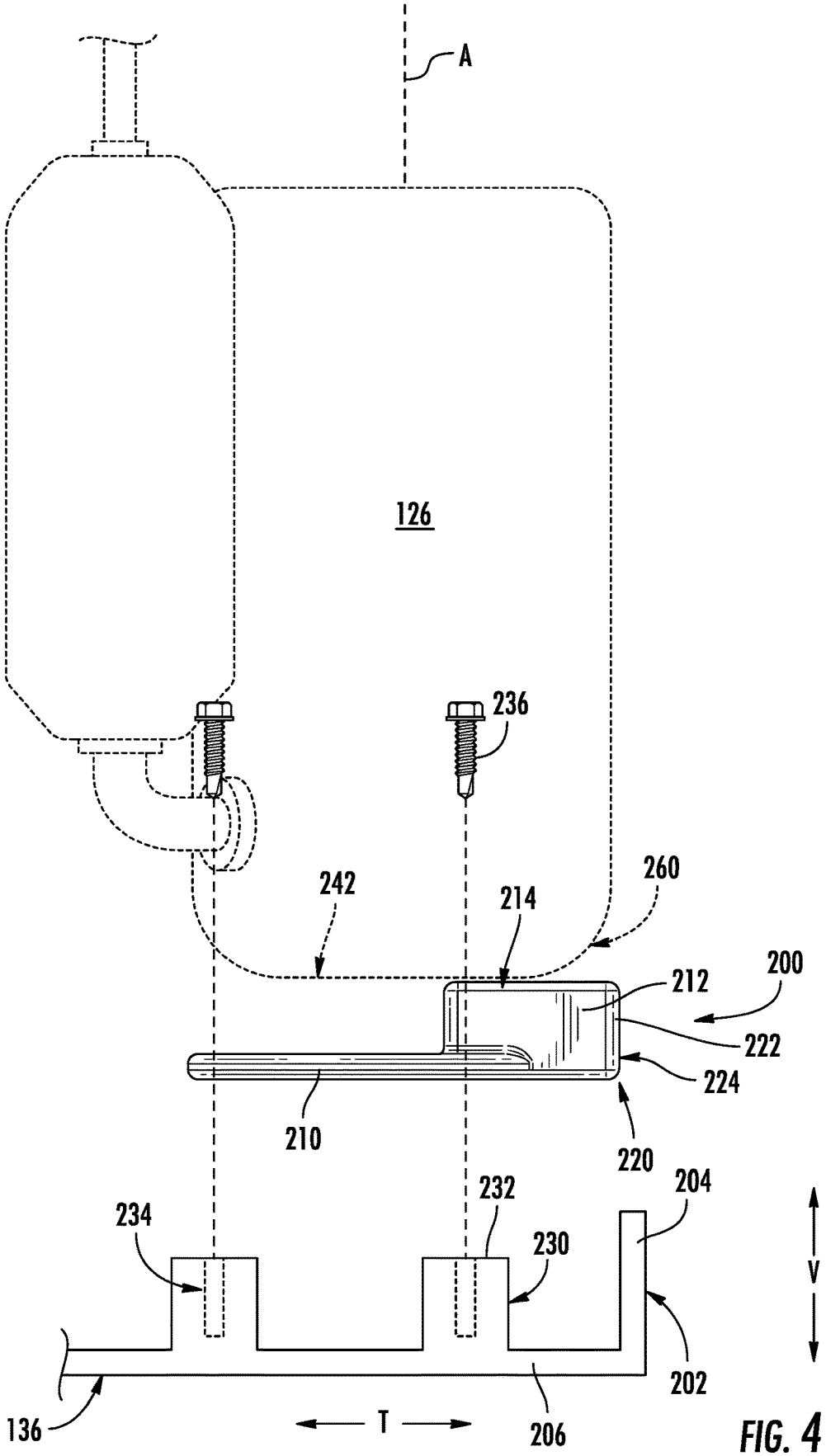
FIG. 4 provides a side view of the exemplary compressor and damper of FIG. 3 according to an exemplary embodiment of the present subject matter.
Figure 5:
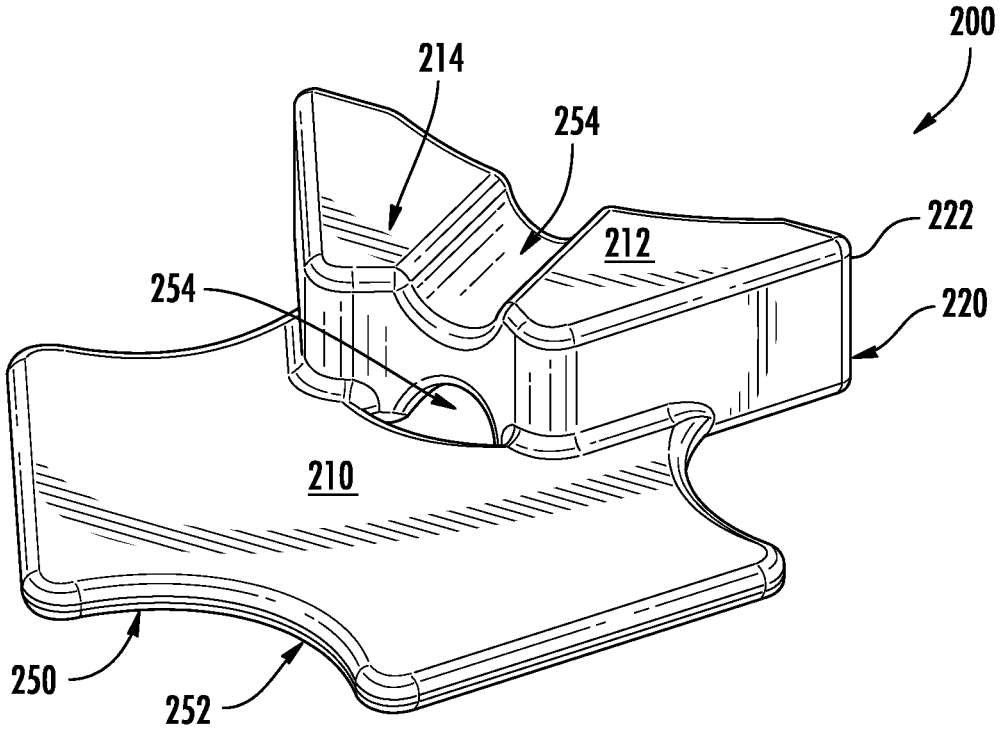
FIG. 5 provides a top, perspective view of the exemplary damper of FIG. 3 according to an exemplary embodiment of the present subject matter.
Figure 6:
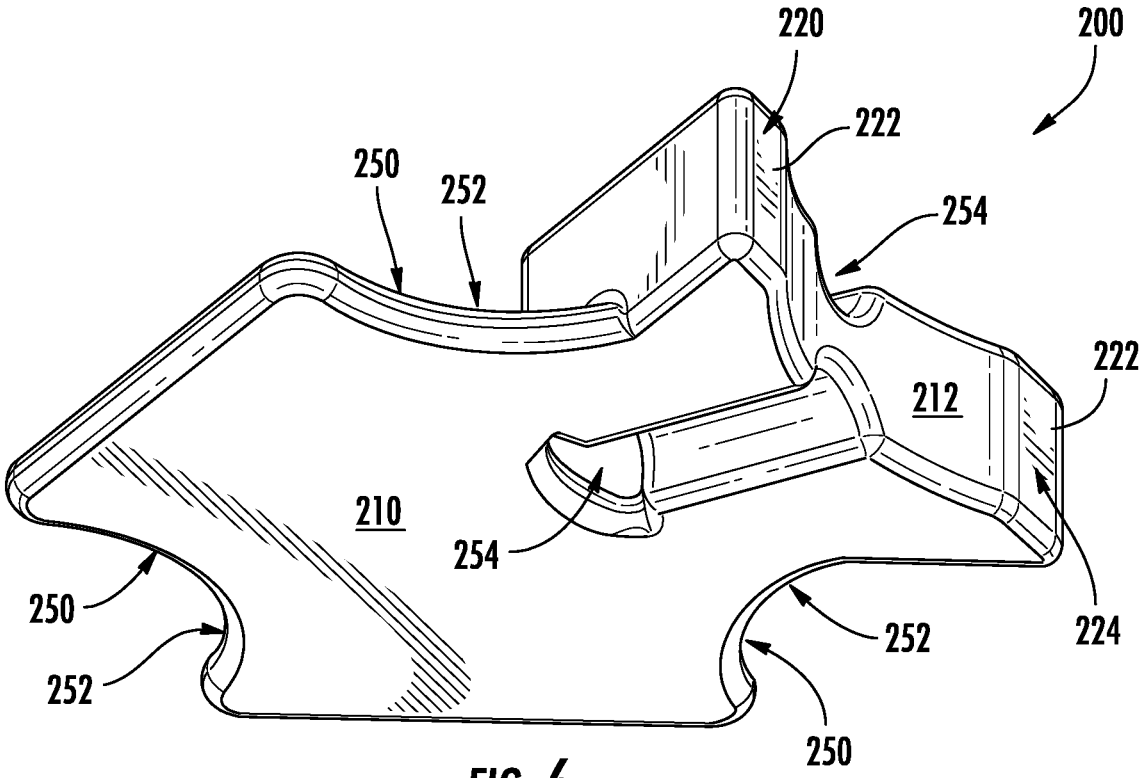
FIG. 6 provides a bottom, perspective view of the exemplary damper of FIG. 3 according to an exemplary embodiment of the present subject matter.

Specifically, referring now generally to FIGS. 3 through 6, a damper 200 that may be used to reduce vibrations and/or noise will be described according to exemplary embodiments of the present subject matter. Specifically, FIGS. 3 and 4 illustrate schematic exploded views of compressor 126 being installed onto base pan 136 of air conditioner 100 with damper 200 positioned therebetween. In addition, FIGS. 5 and 6 illustrate top and bottom perspective views, respectively, of damper 200. Although damper 200 is described herein as being used with air conditioner 100, it should be appreciated that damper 200 could alternatively be used in any other suitable air conditioner for reducing vibrations generated by a sealed system compressor. In addition, it should be appreciated that the exemplary illustrated embodiment of damper 200 is used only to describe aspects of the present subject matter and is not intended to be limiting in any manner.

As shown, damper 200 is generally positioned between compressor 126 and base pan 136, e.g., in order to isolate compressor 126 or mitigate the transmission of vibrations from compressor 126 to the rest of air conditioner 100. Specifically, damper 200 is particularly suitable for damping the torsional vibrations generated by compressor 126 during operation. In this regard, these torsional vibrations may be generated about a vertical axis A of compressor 126 that is parallel to the vertical direction V. Damper 200 may also be suitable for damping other noise or vibrations generated by compressor 126.

As illustrated, base pan 136 may define various alignment and/or locking features to secure damper 200 in position relative to cabinet 102. In this regard, as best illustrated in FIGS. 3 and 4, base pan 136 may generally define at least one alignment feature 202. Specifically, according to the illustrated embodiment, alignment feature 202 may be a vertical wall 204 that extends upward along the vertical direction V from a bottom wall 206 of base pan 136. As explained in more detail below, vertical wall 204 is generally positioned to facilitate proper positioning of damper 200 and to prevent rotation of damper 200 when in the installed position.

As illustrated, damper 200 generally includes a lower pad 210 that is seated directly on base pan 136. In particular, lower pad 210 is generally a thin, flat portion of damper that is seated against bottom wall 206 of base pan 136. In this manner, lower pad 210 may have a large surface area in direct contact with base pan 136 for improved engagement and frictional contact. In addition, damper 200 may include an upper pad 212 that extends upward along the vertical direction V from lower pad 210. For example, a ratio of the thickness of upper pad 212 to the thickness of lower pad 210 may be greater than 1:2, greater than 1:5, greater than 1:10, greater than 2:1, greater than 5:1, greater than 10:1, greater than 20:1, or greater. Upper pad 212 may generally define an upper contact surface 214 that is designed to engage compressor 126 when compressor 126 and damper 200 are installed as described below.

As explained briefly above, damper 200 may include features for engaging alignment features 202 of base pan 136. In this regard, damper 200 may include at least one stopping feature 220 that is defined on at least one of lower pad 210 or upper pad 212 and is generally configured for engaging alignment features 202 to prevent rotation of damper 200. Specifically, according to the illustrated embodiment, the stopping features 220 of damper 200 include extension wings 222 that extend from upper pad 212 and define lateral contact surfaces 224. These lateral contact surfaces are spaced apart and act as stabilizing feet for aligning damper 200 when positioned against vertical wall 204. In this regard, when damper 200 is installed, lateral contact surfaces 224 are seated against vertical wall 204 such that rotation of damper 200 is prevented.

Damper 200 may further include features for ensuring that compressor 126 is firmly secured to base pan 136 and that damper 200 remains in place and in engagement with vertical wall 204 to prevent rotation during compressor operation. In this regard, for example, base pan 136 may define mounting features 230 that are used both to mount compressor 126 and lock the position of damper 200. Specifically, according to the illustrated embodiment, mounting features 230 include a plurality of vertically extending mounting bosses 232 that extend upward from bottom wall 206 of base pan 136. According to the illustrated embodiment, each mounting boss 232 defines an aperture 234 (e.g., a threaded hole) that may be designed for receiving a mechanical fastener 236 for securing compressor 126 to base pan 136.

Specifically, referring still to FIGS. 3 and 4, compressor 126 may include a mounting bracket 240 that extends from a bottom wall 242 of compressor 126. For example, mounting bracket 240 may be a metal bracket with an aperture 244 defined therethrough for receiving fastener 236. In this regard, fastener 236 may pass through mounting bracket 240 and engage mounting boss 232 through the threaded aperture 234 to secure compressor 126 to base pan 136. According to exemplary embodiments, a grommet or another resilient element be positioned between the mounting brackets 240 and mounting bosses 232 to further isolate compressor 126.

As explained above, mounting features 230 may also help locate and secure damper 200 relative to base pan 136. In this regard, for example, damper 200 may define one or more locating features 250 that are designed to correspond with or otherwise be complementary to mounting features 230 of base pan 136. In this regard, when damper 200 is properly positioned in the installed position, locating features 250 engage mounting features 230. Specifically, as illustrated, locating features 250 include a plurality of arcuate recesses 252 that are defined in the perimeter of lower pad 210. The curvature of arcuate recesses 252 may correspond to the curvature of mounting bosses 232. As such, mounting bosses 232 may ensure that damper 200 is not able to slide away from the vertical wall 204 and may also help prevent rotation of damper 200.

Although mounting features 230 are illustrated herein as being three cylindrical mounting bosses 232 and locating features 250 are illustrated as complementary arcuate recesses 252, it should be appreciated that the number, size, position, geometry, and configuration of mounting features 230 and locating features 250 may vary while remaining within the scope of the present subject matter. In this regard, any suitable complementary structures that facilitate accurate positioning of damper 200 and which prevent rotation of damper 200 may be used. In addition, damper 200 may define additional features for improved performance, reduced cost, or simplified installation. For example, damper 200 may define a plurality of finger holes 254 which may be gripped by a technician to simplify installation.

In general, damper 200 may be designed to be a resilient element that is compressed between base pan 136 and compressor 126 when in the installed position. In this regard, when mechanical fasteners 236 fully engage or are bottomed out in threaded aperture 234, mounting bracket 240 should be securely seated on mounting bosses 232 and damper 200 should be slightly deformed and in firm contact with both bottom wall 206 of base pan 136 (e.g., via lower pad 210) and a bottom wall 242 compressor 126 (e.g., via upper pad 212).

Damper 200 may generally be designed and positioned to achieve suitable engagement with compressor 126 for reducing torsional vibration. In this regard, as best illustrated in FIG. 4, damper 200 may be designed such that upper pad 212 engages an outer perimeter 260 of bottom wall 242 of compressor 126. In this manner, by engaging outer perimeter 260, the torsional resistance or resistive torque applied relative to the vertical axis A of compressor 126 may be increased. In addition, according to the illustrated embodiment damper 200 may contact between about 5% and 50%, between about 10% and 40%, between about 20% and 30%, or about 25% of a surface area of bottom wall 242 of compressor 126. According to still other embodiments, any suitable percent engagement between damper 200 and bottom wall 242 may be used.

In general, damper 200 may be formed from any material suitable for reducing the transmission of vibrations from compressor 126 to other portions of air conditioner 100 through base pan 136. In this regard, for example, damper 200 may be formed from any suitably resilient material, such as a polymer, rubber, plastic, etc. In addition, according to exemplary embodiments, damper 200 may have a hardness of between about 60 and 100 Shore A durometer, between about 70 and 90 Shore A durometer, or about 80 Shore A durometer. In this regard, it should be understood that the Shore durometer is a device and measurement standard for the hardness of materials such as polymers, elastomers, and rubbers. The Shore A scale is between 0 and 100 Shore A, where higher numbers on the scale indicate a greater resistance to indentation and thus harder materials. It should be appreciated that other suitable materials having other suitable material characteristics and geometries may be used while remaining within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical, a lateral, and a transverse direction, the air conditioner unit comprising:

a cabinet comprising a base pan, the base pan defining at least one alignment feature;

a bulkhead mounted within the cabinet to define an indoor portion and an outdoor portion;

a refrigeration loop comprising an outdoor heat exchanger positioned within the outdoor portion and an indoor heat exchanger positioned within the indoor portion;

a compressor operably coupled to the refrigeration loop and being configured for urging a flow of refrigerant through the outdoor heat exchanger and the indoor heat exchanger; and a damper positioned between the compressor and the cabinet, the damper comprising:

a lower pad seated on the base pan;

an upper pad extending from the lower pad along the vertical direction and contacting a bottom surface of the compressor; and at least one stopping feature defined on the lower pad or the upper pad, the at least one stopping feature engaging the at least one alignment feature to prevent rotation of the damper, wherein the at least one stopping feature comprises extension wings that extend from the upper pad and define lateral contact surfaces that engage the base pan to prevent rotation of the damper.

2. The air conditioner unit of claim 1, wherein the at least one alignment feature comprises a vertical wall defined by the base pan, wherein the extension wings engage the vertical wall to prevent rotation of the damper.

3. The air conditioner unit of claim 1, wherein the base pan defines a mounting feature and the damper defines a locating feature for engaging the mounting feature when the damper is positioned on the base pan.

4. The air conditioner unit of claim 3, wherein the mounting feature comprises a mounting boss extending upward from the base pan and defining an aperture, and wherein the locating feature is an arcuate recess that engages the mounting boss when the damper is positioned on the base pan.

5. The air conditioner unit of claim 4, further comprising:

a mounting bracket extending from the compressor; and a fastener that passes through the mounting bracket and into the aperture in the mounting boss to secure the compressor to the base pan.

6. The air conditioner unit of claim 1, wherein the damper is compressed between the base pan and the compressor in an installed position.

7. The air conditioner unit of claim 1, wherein the damper defines one or more finger holes on the upper pad to facilitate installation of the damper.

8. The air conditioner unit of claim 1, wherein the damper is formed from a polymer material.

9. The air conditioner unit of claim 8, wherein the damper is formed from rubber.

10. The air conditioner unit of claim 1, wherein the damper has a hardness of between 60 and 100 Shore A durometer.

11. The air conditioner unit of claim 10, wherein the damper has a hardness of about 80 Shore A durometer.

12. The air conditioner unit of claim 1, wherein the damper contacts the compressor on an outer perimeter of a bottom of the compressor.

13. The air conditioner unit of claim 1, wherein the damper contacts between about 10% and 40% of a surface area of a bottom of the compressor.

14. The air conditioner unit of claim 1, wherein the damper contacts about 25% of a surface area of a bottom of the compressor.

15. The air conditioner unit of claim 1, wherein the compressor is a variable speed compressor.

16. The air conditioner unit of claim 1, wherein the air conditioner unit is a single package vertical unit, a vertical terminal air conditioner unit, or a packaged terminal air conditioner unit.

17. A damper for a compressor of an air conditioner unit, the air conditioner unit comprising a base pan defining at least one alignment feature, the damper comprising:

a lower pad seated on the base pan;

an upper pad extending from the lower pad along a vertical direction and contacting a bottom surface of the compressor; and at least one stopping feature defined on the lower pad or the upper pad, the at least one stopping feature engaging the at least one alignment feature to prevent rotation of the damper, wherein the damper is formed from rubber and has a hardness of about 80 Shore A durometer.

18. The damper of claim 17, wherein the at least one stopping feature comprises extension wings that extend from the upper pad and define lateral contact surfaces that engage the base pan to prevent rotation of the damper, and wherein the at least one alignment feature comprises a vertical wall defined by the base pan, wherein the extension wings engage the vertical wall to prevent rotation of the damper.

19. An air conditioner unit defining a vertical, a lateral, and a transverse direction, the air conditioner unit comprising:

a cabinet comprising a base pan, the base pan defining at least one alignment feature and a mounting feature, wherein the mounting feature comprises a mounting boss extending upward from the base pan and defining an aperture;

a bulkhead mounted within the cabinet to define an indoor portion and an outdoor portion;

a refrigeration loop comprising an outdoor heat exchanger positioned within the outdoor portion and an indoor heat exchanger positioned within the indoor portion;

a compressor operably coupled to the refrigeration loop and being configured for urging a flow of refrigerant through the outdoor heat exchanger and the indoor heat exchanger, wherein a mounting bracket extends from the compressor, and wherein a fastener that passes through the mounting bracket and into the aperture in the mounting boss to secure the compressor to the base pan; and a damper positioned between the compressor and the cabinet, the damper comprising:

a lower pad seated on the base pan;

an upper pad extending from the lower pad along the vertical direction and contacting a bottom surface of the compressor;

at least one stopping feature defined on the lower pad or the upper pad, the at least one stopping feature engaging the at least one alignment feature to prevent rotation of the damper; and a locating feature for engaging the mounting feature when the damper is positioned on the base pan, wherein the locating feature is an arcuate recess that engages the mounting boss when the damper is positioned on the base pan.

* * * * *